United States Patent [19]

Owens

[11] Patent Number: 4,864,755

[45] Date of Patent: Sep. 12, 1989

[54] SYSTEM FOR MOUNTING MULTIPART FORMS

[76] Inventor: B. Victor Owens, 5028 30th St., NE., Tacoma, Wash. 98422

[21] Appl. No.: 121,679

[22] Filed: Nov. 17, 1987

[51] Int. Cl.[4] ..... G09F 7/12

[52] U.S. Cl. ..... 40/594; 40/158.1; 40/644; 40/661

[58] Field of Search ..... 40/643, 644, 661, 594, 40/591, 593, 910, 158.1, 626, 630, 615, 595, 299

[56] References Cited

U.S. PATENT DOCUMENTS

| | | | |
|---|---|---|---|
| 1,368,519 | 2/1921 | Mongan | 283/60 R |
| 1,996,288 | 4/1935 | Galt | 40/630 |
| 2,100,840 | 11/1937 | Elmore | 283/105 |
| 2,110,768 | 3/1938 | Kellogg | 40/643 |
| 2,246,984 | 6/1941 | Palmer | 40/299 |
| 2,603,899 | 7/1952 | Leander | 40/594 |
| 2,984,922 | 5/1961 | Ladenburger et al. | 40/159 |
| 3,826,026 | 7/1974 | Bevan | 40/10 B |
| 3,849,913 | 11/1974 | Williams, Sr. | 434/150 |
| 4,305,216 | 12/1981 | Skelton | 40/10 B |

*Primary Examiner*—Gene Mancene
*Assistant Examiner*—Cary E. Stone
*Attorney, Agent, or Firm*—Joan H. Pauly

[57] ABSTRACT

A transparent backing sheet (36) with a cover sheet (50) secured thereto by a layer (46) of pressure sensitive adhesive is cut to size. The center portion (56) of the cover sheet (50) is cut, without cutting through the backing sheet (36), and peeled away, leaving a frame-like cover (58). The back page (26) of a three-page form (20) is secured to the exposed adhesive (46). A corner (b 60) of the cover (58) is severed from the main portion of the cover (58) without cutting through the backing sheet (36). The cover (58) is peeled off the backing sheet (36) by grasping the corner (60) with one hand and the main portion of the cover (58) with the other hand. The exposed marginal area of adhesive (46) is pressed against the inner surface of the automobile window (16, 72) to secure the backing sheet (36) to the window (16, 72) around the entire periphery of the backing sheet (36). The backing sheet (36) holds the form (20) flush against the window (16, 72).

10 Claims, 3 Drawing Sheets

Fig. 1
PRIOR ART
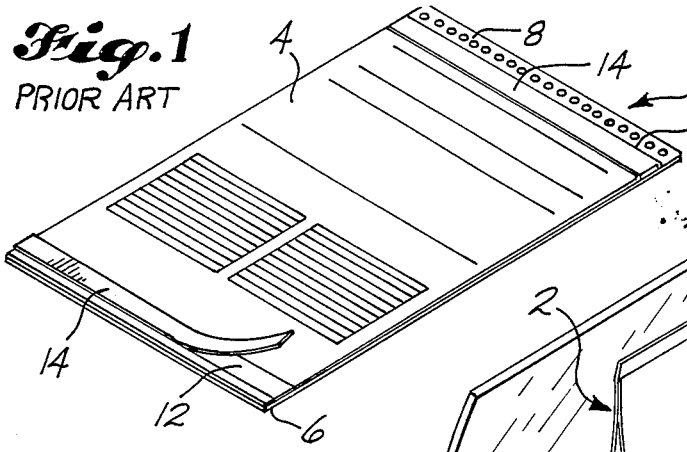
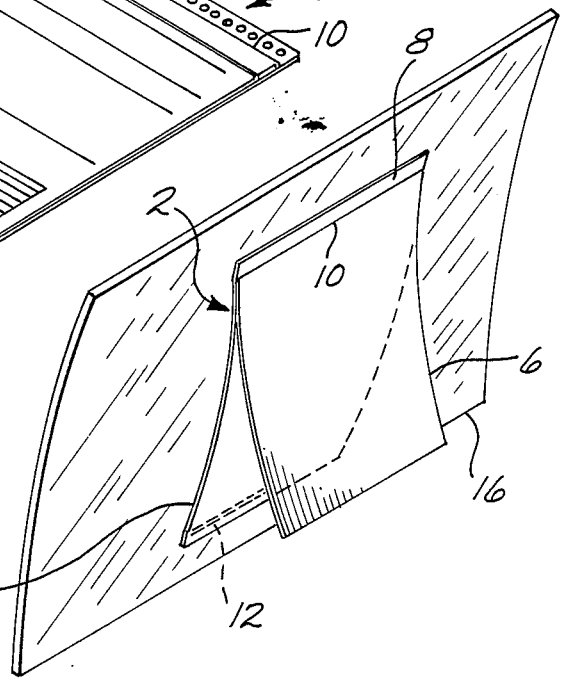
Fig. 2
PRIOR ART
Fig. 3
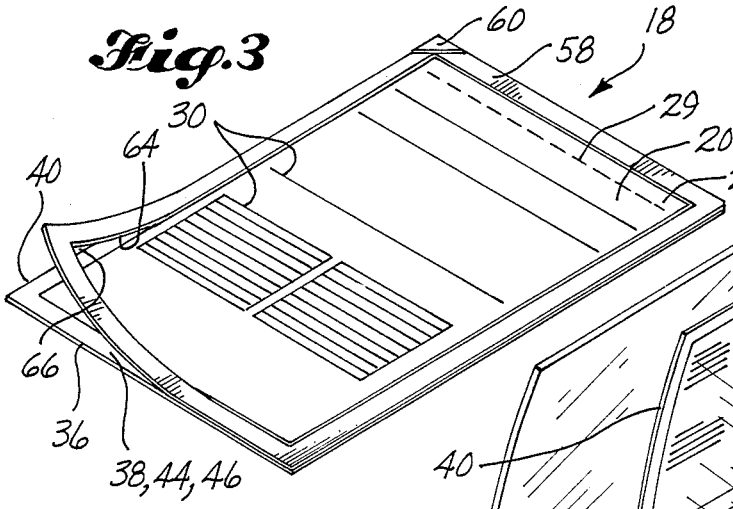
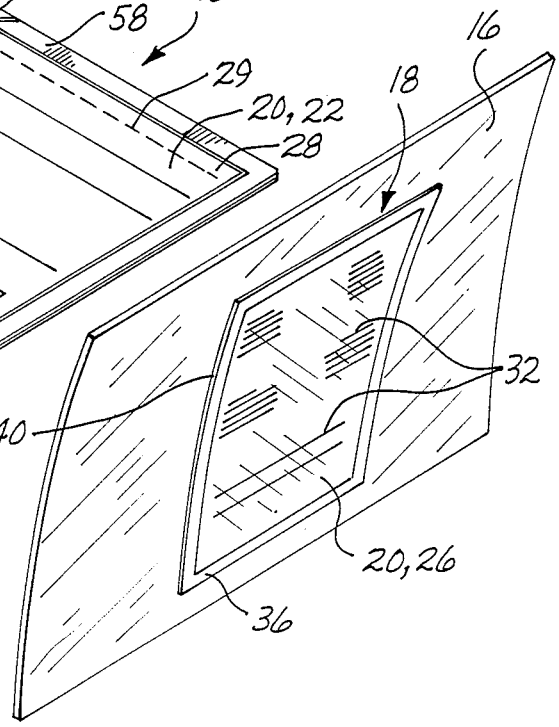
Fig. 4

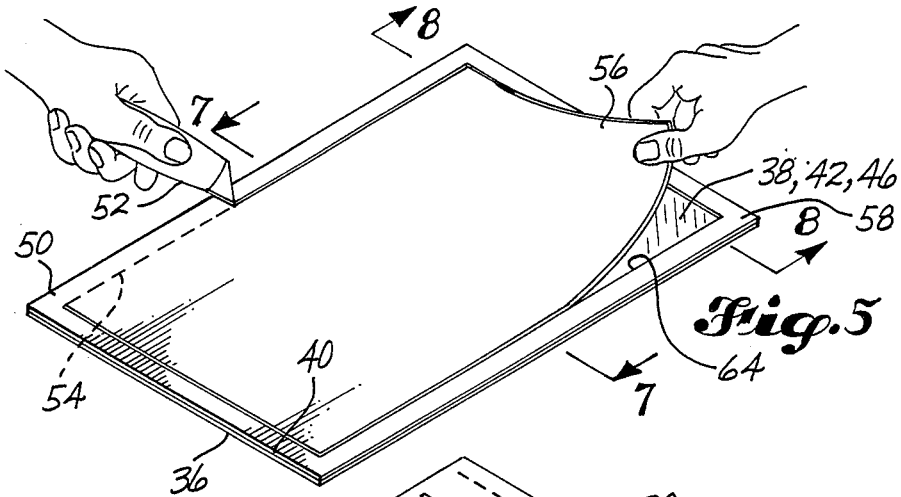
Fig. 5
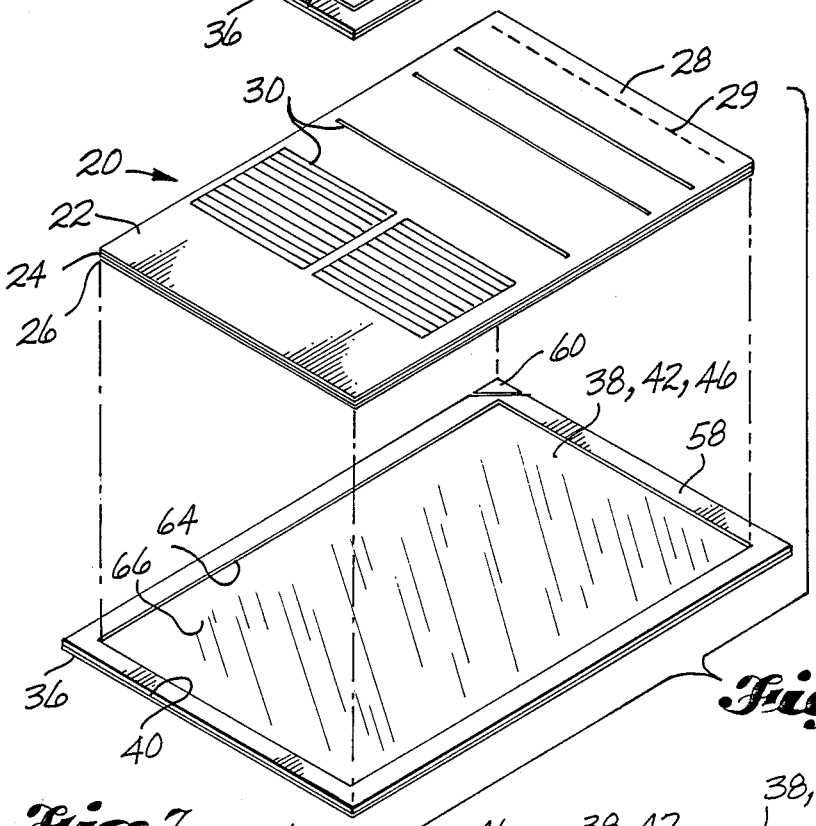
Fig. 6
Fig. 7
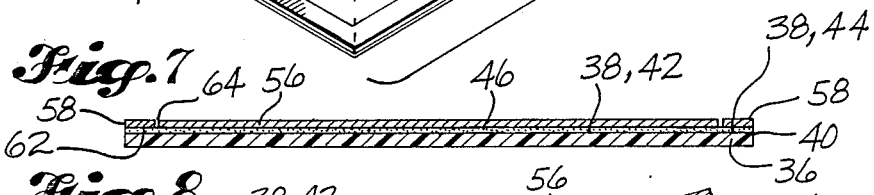
Fig. 8
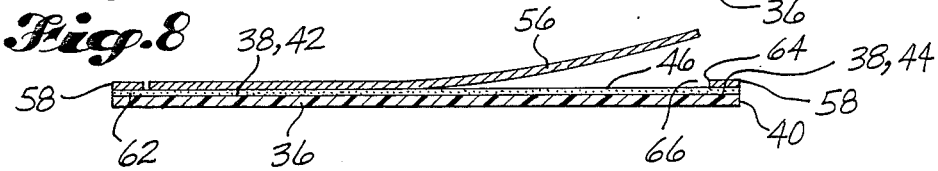

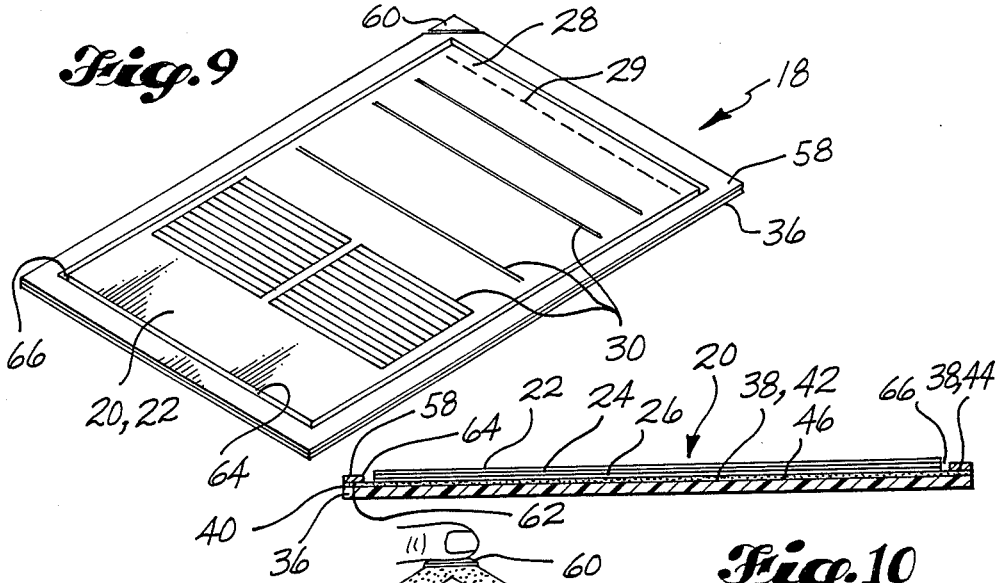
Fig. 9
Fig. 10
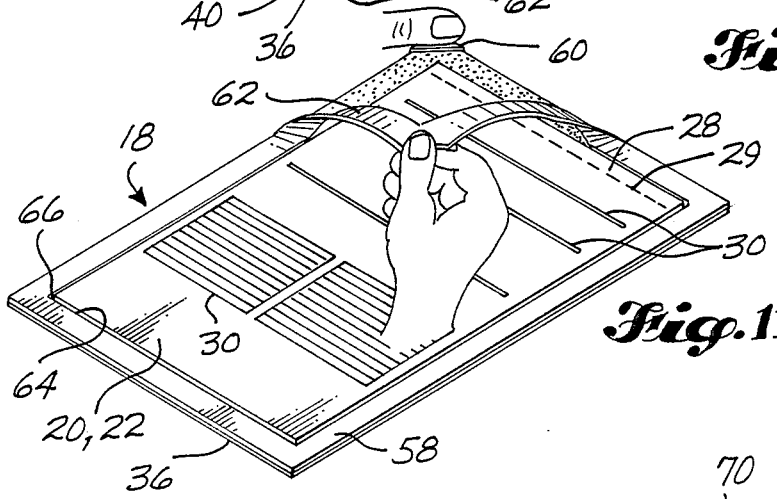
Fig. 11
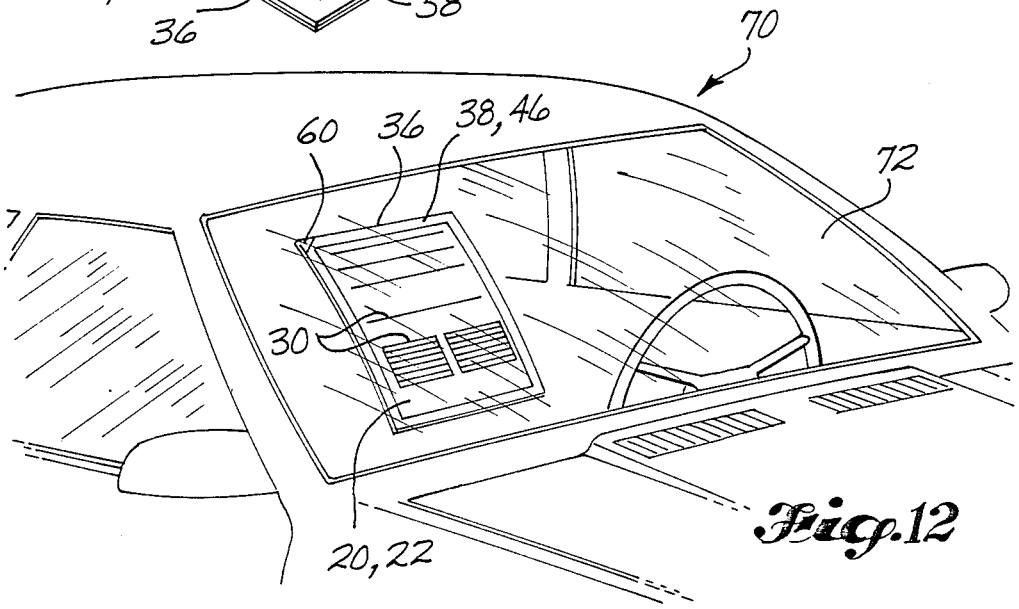
Fig. 12

SYSTEM FOR MOUNTING MULTIPART FORMS

TECHNICAL FIELD

This invention relates to systems for mounting multipart forms and, more particularly, to such a system in which the form is adhesively attached to the center portion of a transparent backing sheet, and a marginal area of the backing sheet is releasably adhesively attached to a transparent member around the entire periphery of the backing sheet to mount the backing sheet and the multipart form flush with the member.

BACKGROUND ART

Federal law requires that multipart forms be conspicuously mounted on all used cars being offered for sale. These forms are customarily mounted on the windows of the cars. A current commonly used method of mounting the forms uses forms with strips of pressure sensitive adhesive on the upper and lower portions of the front page of the form. The forms are mounted by pressing the strips of adhesive against a windshield, side window, or rear window.

A number of problems have been encountered in connection with this common method of mounting the forms. Since the back sheet of the form is not secured or protected, it can become damaged and/or separated from the front sheet. If the form is mounted on a windshield or some other sloping window, this problem is aggravated because the back sheet tends to hang away from the window or windshield and the front sheet of the form. If the form is mounted on an openable window, the loose back sheet interferes with the opening of the window and can be damaged or separated if opening of the window is attempted. These problems are encountered in connection with substantially vertical openable windows as well as sloping openable windows. The mounting of the form is also not very secure, and sometimes the entire form separates from the mounting surface. This is a serious problem since the law prohibits removal of the form before purchase of the vehicle, except for the purpose of test driving. Even if the form is not damaged or separated from its mounting surface, the mounted form is relatively unsightly and, therefore, can detract from the sale appeal of the vehicle.

U.S. Pat. No. 4,305,216, granted Dec. 15, 1981, to S. Skelton, discloses a card holder for mounting on a vehicle interior surface, such as a sun visor. The holder is designed so that the card may easily be inserted and removed from the holder, for example to update or replace a maintenance information card. The holder includes a sheet having two transparent layers held together by a transparent adhesive. A marginal portion of one of the layers around three sides of the holder peels away from the other layer to expose the pressure sensitive adhesive. The holder is mounted on the sun visor or other vehicle surface by means of the exposed adhesive. The fourth edge of the holder is beveled and remains open when the holder is mounted so that cards may be inserted and removed. The holder forms a pocket between the transparent two-layered sheet and the vehicle surface on which the holder is mounted. A corner of a card in the holder extends out from the holder to facilitate insertion and removal of the card.

U.S Pat. No. 2,100,840, granted Nov. 30, 1937, to C. E. Elmore, discloses a decalcomania license sticker for the windshield of a vehicle. The sticker is designed to deter theft of the vehicle. The license number is formed on the sticker by circular perforations through the sticker which are backed by paper of a contrasting color. The contrasting paper is either folded up from the bottom of the sticker and held in position by a backing sheet or separately adhered to the back of the sticker by upper and lower strips of adhesive.

U. S. Pat. No. 1,996,288, granted Apr. 2, 1935, to E. Galt, discloses a decalcomania certificate of ownership designed to be unremovably attached to the inside of a windshield to deter theft. U.S. Pat. No. 3,849,913, granted Nov. 26, 1974, to B. A. Williams, Sr., discloses a display map for mounting by pressure sensitive adhesive on an automobile window. The map also has adhesive on its outer surface to permit the display of individual states to be selectively altered. U.S. Pat. No. 3,826,026, granted Jul. 30, 1974, to B. Bevan, discloses a removable display device for an automobile. The device includes a magnetic backing sheet and a transparent cover heat sealed to form a pocket for receiving a sign or other indicia sheet to be displayed. U.S. Pat. No. 1,368,519, granted Feb. 15, 1921, to J. Mongan, discloses an automobile title form with a duplicate detachably connected and tear off coupons. U.S. Pat. No. 2,984,922, granted May 23, 1961, to L. Ladenburger et al., discloses a picture mount with a picture-receiving pocket formed by backing paper and a ribbed frame.

The above patents and the prior art that is discussed and/or cited therein should be studied for the purpose of putting the present invention into proper perspective relative to the prior art.

Disclosure of the Invention

A subject of the invention is an assembly for mounting a multipart form on a transparent member, such as an automobile window. According to an aspect of the invention, the assembly comprises a backing sheet having a mounting surface bounded by an outer periphery. A layer of pressure sensitive adhesive is carried by a marginal area of the mounting surface. The layer has an outer boundary substantially coextensive with the outer periphery of the mounting surface. A sheet material cover has an attaching surface substantially coextensive with the marginal area. The cover also has inner edges that define a center opening in the cover adjacent to a center portion of the mounting surface. The attaching surface is releasably adhesively attached to the marginal area of the mounting surface by the layer of adhesive. The assembly further comprises a multipart form including a back page and a front page. The back page is substantially coextensive with and adhesively attached to the center portion of the mounting surface. The front page is attached to the back page along an edge portion thereof. The front page has a front surface positioned to be visible through a transparent member on which the form has been mounted by removing the cover and pressing the layer of adhesive against the member.

A preferred feature of the invention is a center portion of the backing sheet which is transparent, in combination with a back surface of the back page positioned to be visible through the center portion. This preferred feature allows both the front and the back of the form to be visible when the form is mounted. Another preferred feature is a cover which has a separate corner portion positioned and dimensioned to be grasped by the tip of a person's thumb. This feature facilitates separation of the cover from the backing sheet.

Another subject of the invention is a method of mounting a multipart form on a transparent member, such as an automobile window, said form being of a type having a back page and a front page attached to the back page along an edge portion thereof. According to an aspect of the invention, the method comprises providing a backing sheet having a mounting surface with a marginal area that carries a layer of pressure sensitive adhesive. Also provided is a cover releasably adhesively attached to the marginal area by the layer of adhesive. The cover is provided with a center opening adjacent to a center portion of the backing sheet. The back surface of the back page of the form is adhesively attached to the center portion of the backing sheet. The cover is peeled off the backing sheet. The layer of adhesive and the front surface of the front page of the form are positioned adjacent to a surface of the transparent member. The layer of adhesive is pressed against the surface of the member to releasably adhesively attach the backing sheet to the member around substantially the entire periphery of the backing sheet. The method also comprises allowing the backing sheet to hold the form flush against the surface of the transparent member.

Preferably, the layer of adhesive extends over and is carried by substantially the entire extent of the mounting surface. Also preferably, the steps of providing the cover and providing the cover with a center opening comprise providing a sheet of cover material adhered to substantially the entire extent of the mounting surface by the layer of adhesive. The steps also include cutting substantially through the sheet of cover material but not through the backing sheet along a path defining the center portion of the mounting surface, and peeling the portion of the sheet of cover material adjacent to said center portion off the backing sheet. This preferred procedure facilitates assembly of the form, backing sheet, and cover preparatory to attaching the backing sheet to the transparent member. The procedure also helps reduce the cost and increase the flexibility of the overall method.

In its preferred form, the method further comprises forming a separate corner portion of the cover by cutting substantially through the cover but not through the backing sheet. The corner portion is dimensioned to be grasped by the tip of a person's thumb. The step of peeling the cover off comprises grasping the corner portion. The grasping of the corner portion facilitates the peeling of the cover. When the method includes both the forming of a separate corner portion and the preferred procedure for providing the cover described above, the corner portion may be formed at the same time that the cover opening is formed to help maximize the efficiency of the method.

The method and assembly of the invention solve the problems discussed above that have been encountered in connection with current procedures for mounting multipart forms on automobile windows and windshields. Since the layer of pressure sensitive adhesive that attaches the backing sheet to the window or windshield has an outer boundary substantially coextensive with the outer periphery of the mounting surface of the backing sheet, the form is mounted firmly and securely against the window or windshield. The form is held flush against the window or windshield by the backing sheet. Thus, the problem of damage to or loss of loose back pages is eliminated. In addition, the attachment of the backing sheet around its entire periphery prevents the form from being damaged or displaced by accidental causes, such as becoming caught in a window lowering mechanism. In summary, there are no flapping pages or projecting portions of the form which would be exposed to accidental damage.

The system of the invention also has the advantages of protecting the form from becoming accidentally detached from the window or windshield and from exposure to moisture and other environmental factors. When the form assembly is mounted on an openable window, the window may be opened and closed without damaging or detaching the assembly. The assembly may also be easily run through a typewriter or printer before the cover is removed and the form and backing sheet are attached to the vehicle. The system of the invention allows multipart forms to be easily and inexpensively mounted on vehicles. The system decreases the overall cost of mounting and maintaining such forms since the necessity for replacing damaged or lost forms is virtually eliminated. In addition, the system of the invention provides mounted forms which are neat and attractive and enhance the visual appeal of used car inventory.

These and other advantages and features will become apparent from the detailed description of the best mode for carrying out the invention that follows.

BRIEF DESCRIPTION OF THE DRAWINGS

In the drawings, like element designations refer to like parts throughout, and:

FIG. 1 is a pictorial view of a prior art form with means for mounting the form.

FIG. 2 is a pictorial view of the form shown in FIG. 1 mounted on a window.

FIG. 3 is a pictorial view of the preferred embodiment of the mounting assembly of the invention.

FIG. 4 is a pictorial view of the form shown in FIG. 3 mounted on a vehicle window.

FIGS. 5 and 6 are pictorial views illustrating steps of the preferred embodiment of the method which produce the assembly shown in FIGS. 3 and 4.

FIGS. 7 and 8 are sectional views taken substantially along the lines 7—7 and 8—8, respectively, in FIG. 5.

FIG. 9 is a pictorial view of the completed assembly.

FIG. 10 is a sectional view of the assembly shown in FIG. 9.

FIG. 11 is a pictorial view illustrating the peeling of the marginal cover off the backing sheet.

FIG. 12 is a pictorial view showing the preferred embodiment mounted on an automobile windshield.

BEST MODE FOR CARRYING OUT THE INVENTION

The drawings show an assembly 18 for mounting a multipart form on a transparent member, such as an automobile window. The assembly 18 shown in the drawings is constructed according to the invention and also constitutes the best mode for carrying out the apparatus aspects of the invention currently known to the applicant. The drawings also illustrate the best mode for carrying out the method of the invention currently known to the applicant. In the drawings, the assembly 18 is shown mounted on automobile windows 16, 72. As used herein, the term "window", in reference to automobiles, includes windshields, such as that shown in FIG. 12, as well as both openable and fixed side and rear windows. Although the drawing show the assembly 18 of the invention mounted on automobile windows, it is intended to be understood that the system of the invention may also be used to advantage in connection with mounting multipart forms on other transparent surfaces.

The type of form described above which is currently in common use is shown in FIGS. 1 and 2 for the purpose of illustrating some of the problems that have arisen in connection with the use of this type of form. The form 2 has two pages 4, 6, which are secured together along their upper edge portions 8. Each of the pages 4, 6 has perforations 10 just below its upper edge portion 8 to allow the page 4, 6 to be easily detached from its upper edge portion 8 and the other page 4, 6. The front surface of the front page 4 carries upper and lower strips 12 of pressure sensitive adhesive. These strips 12 of adhesive are covered in a conventional manner with protective paper strips 14 to protect the adhesive during storage prior to the mounting of the form 2 on an automobile window 16. FIG. 1 shows the lower protective paper strip 14 partially peeled away. FIG. 2 shows the form 2 mounted on an automobile window 16. As can be seen in FIG. 2, the front page 4 of the form 2 does not conform to the curved surface of the window 16. The middle of the front page 4 sags away from and is not flush with the surface of the window 16. In addition, the back page 6 is hanging away from the front page 4 and the window 16. Both the sagging of the front page 4 and the loose hanging of the back page 6 make the form 2 vulnerable to accidental damage and/or detachment from the window 16.

FIGS. 3 and 4 show, for the purpose of comparison, views of the preferred embodiment of the assembly 18 of the invention similar to the views shown in FIGS. 1 and 2. FIG. 3 is a pictorial view of the assembly 18 with a portion of the protective marginal cover 58 shown detached for the purpose of comparing the cover 58 with the protective strips 14 shown in FIG. 1. FIG. 4 is a pictorial view of the assembly 18 mounted on a car window 16. The entire assembly 18 is flush with and conforms to the shape of the surface of the window 16, and no portion of the assembly 18 is loose or hanging away from the window 16. As can be seen in FIG. 4, this flush mounting is accomplished without sacrificing the visibility of the printing 32 on the back of the back page 26 of the multipart form 20.

The preferred embodiment of the assembly 18 is shown in FIGS. 3, 4, and 9–12. The assembly 18 includes a backing sheet 36, which is preferably formed from a transparent material as shown in FIGS. 4–6. A suitable material for the backing sheet 36 is, for example, a 2.0 mil sheet of polyester. The backing sheet 36 has a mounting surface 38 which, in the preferred embodiment, coincides with the entire front surface of the backing sheet 36. The mounting surface 38 is preferably rectangular and has a rectangular center portion 42 surrounded by a marginal area 44. The four-sided marginal area 44 is defined by the outer periphery 40 of the mounting surface 38 and the outer edges of the center portion 42. A layer of pressure sensitive adhesive 46 is carried by the marginal area 44 of the mounting surface 38. The layer 46 has an outer boundary that is substantially coextensive with the outer periphery 40 of the mounting surface 38. In the preferred embodiment, the layer 46 extends over and is carried by the entire mounting surface 38.

The assembly 18 also includes a multipart form 20. The form 20 includes a front page 22, a middle page 24, and a back page 26. The form includes three pages, rather than two pages like the form shown in FIGS. 1 and 2, because the back page 26 is adhesively attached to the backing sheet 36 and is discarded with the backing sheet 36 when the vehicle is purchased. The front and middle pages 22, 24 provide two copies for the seller and buyer. Like the form 2 shown in FIGS. 1 and 2, the pages 22, 24, 26 of the form 20 are attached to each other along upper edge portions 28 thereof. The front and middle pages 22, 24 are provided with perforations 29 just below their upper edge portions 28 to permit them to be easily separated from the rest of the form 20 upon sale of the vehicle. The three pages 22, 24, 26 are essentially identical and have printing front and back. The printing 30 on the front of the front page 22 is shown in FIGS. 3, 6, 9, 11, and 12. The printing 32 on the back of the back page 26 is shown in FIG. 4.

The assembly 18 also includes a frame-like cover 58 which protects the adhesive layer 46 on the marginal area 44 of the backing sheet 36. The cover 58 has an inner attaching surface 62 that is substantially coextensive with the marginal area 44 and is releasably adhesively attached thereto by the layer of adhesive 46. The cover 58 has inner edges 64 which define a rectangular center opening 66 in the cover 58. The opening 66 is coextensive with and adjacent to the center portion 42 of the mounting surface 38. In other words, the inner edges 64 of the cover 58 help to define the center portion 42 of the mounting surface 38 as well as the opening 66. The cover 58 has a small triangular corner portion 60 that is substantially separate from the main portion of the cover 58 and that facilitates separation of the cover 58 from the backing sheet 36, as described below.

FIGS. 5–8 illustrate the initial steps of the preferred embodiment of the method of the invention which produce the assembly 18 described above. The fabrication of the assembly begins with the provision of a rectangular backing sheet 36 having a mounting surface 38 that carries a layer of pressure sensitive adhesive 46 which is coextensive with the backing sheet 36 and the mounting surface 38. The layer of adhesive 46 is protected by a coextensive sheet 50 of cover material. Providing the backing sheet 36 and its protective sheet 50 of cover material can most easily be accomplished by purchasing stock sheets of backing material with protective cover sheets. If necessary, such stock sheets may be cut to size.

When the backing sheet 36 and the cover sheet 50 have been properly sized, an opening 66 is formed in the cover sheet 50 by cutting substantially through the cover sheet 50 but not through the backing sheet 36, as shown in FIGS. 5 and 7. The cover sheet 50 is cut along a path 54 that defines a rectangular center portion 42 of the mounting surface 38 of the backing sheet 36. The center portion 42 is of substantially the same size as the back page 26 of the form 20. Preferably, the cover sheet 50 is cut almost but not quite all the way through, and the backing sheet 36 is left unmarked. However, it does not matter if the backing sheet 36 is scored by the cutting process unless the scoring is sufficiently deep to seriously diminish the strength of the backing sheet 36 in the scored area.

FIG. 5 illustrates the cutting of the opening 66 in the sheet 50 of cover material by a manual procedure using a utility knife 52 of a known type. This manual procedure is the procedure which is currently being used to form the cover 58. However, since the manual procedure is time consuming and requires a considerable amount of skill, it might be preferable to carry out the step of cutting the cover sheet 50 by means of a machine designed for such cutting. There are a number of such machines that are known in the art. A manual procedure, rather than a mechanized procedure, is currently being used because such machines are very expensive and are not specifically adapted for carrying out other steps of the method.

After the cover sheet 50 has been cut all the way around the path 54, or while the cover sheet 50 is being cut, the center portion 56 of the cover sheet 50 is peeled away from the backing sheet 36 to expose the center portion 42 of the mounting surface 38 of the backing sheet 36. The peeling of the center portion 56 is illustrated in FIGS. 5 and 8. The peeling can be done manually, as shown in FIG. 5, or by means of known mechanized cutting systems which peel as well as cut.

The corner thumb-hold portion 60 of the cover 58 is formed in the same manner that the center portion 56 of the cover sheet 50 is cut. However, the corner 60 is not peeled away from the backing sheet 36.

After the center portion 56 of the cover sheet 50 has been peeled away, the back surface of the back page 26 of the form 20 is adhesively attached to the exposed center portion 42 of the mounting surface 38. In order to attach the back page 26, the form 20 is aligned with the mounting surface center portion 42, as shown in FIG. 6. The back page 26 is then moved into contact with and pressed against the center portion 42 to cause the layer of adhesive 46 to attach the back page 26 to the backing sheet 36. The assembly 18 is then complete.

FIGS. 9 and 10 show the completed assembly 18. It should be noted that in FIGS. 9 and 10 and other figures of the drawings, the thickness of the elements of the assembly 18 and the gap between the form 20 and the marginal cover 58 are exaggerated in order to facilitate illustration of the elements of the assembly 18. In most situations, the completed assemblies 18 will be fabricated by a manufacturer who sells them to the ultimate user in quantity. The assemblies 18 will be stored by the user until they are needed. During the storage, the frame-like cover 58, including its severed corner portion 60, serve to prevent the layer 46 of adhesive from damaging or being damaged by articles the assembly 18 may come into contact with.

FIG. 11 illustrates the preparation of an assembly 18 for mounting on an automobile window. All that is required to prepare the assembly 18 is to peel the cover 58 off the backing sheet 36. As shown in FIG. 11, this is easily accomplished by grasping the corner portion 60 of the cover and the underlying corner of the backing sheet 36 between the thumb and fingers of one hand. The corner 60 is then given a slight tug to begin the separation of the main portion of the cover 58 from the backing sheet 36. The truncated corner edge of the cover 58 is grasped and the cover 58 is pulled away from the backing sheet 36 while the corner 60 is still being grasped by the other hand.

When the cover 58 has been removed, the exposed marginal portion of the layer of adhesive 46 and the front surface of the front page 22 of the form 20 are positioned adjacent to the surface of a transparent member on which the form 20 is to be mounted. This might be, for example, the inner surface of the windshield 72 of an automobile 70, such as that shown in FIG. 12. When the assembly is positioned relative to the windshield 72, the exposed adhesive 46 is pressed against the windshield surface to releasably adhesively attach the backing sheet 36 to the windshield 72 around substantially the entire periphery of the backing sheet 36. As shown in FIGS. 4 and 12, when the backing sheet 36 has been attached, the backing sheet 36 holds the form 20 flush against the inner surface of the window 16 or windshield 72 and itself lies flush against such inner surface and the back of the form 20. The printing 30 on the front of the front page 22 is visible through the window 16, 72, as shown in FIG. 12. The printing 32 on the back of the back page 26 is visible through the transparent center portion 42 of the backing sheet 36, as shown in FIG. 4.

When the backing sheet 36 is attached to the window 16, 72, the corner portion 60 of the cover material is preferably left on the backing sheet 36 to facilitate later detachment of the assembly 18 from the window 16, 72. The area of the corner portion 60 is sufficiently small so that the backing sheet 36 is still secured all the way around its periphery to protect and securely attach the form 20, and sufficiently small so that it will not interfere with the opening of a window 16 on which the assembly 18 is mounted.

The assembly 18 may be removed from the window 16, 72 temporarily for a test drive or permanently upon purchase of the vehicle. The detaching of the assembly 18 is easily accomplished simply by grasping the corner 60 and pulling the assembly 18 away from the window 16, 72. If the assembly 18 is being removed temporarily, it may be easily reattached by following the procedure described above for its original attachment. When the assembly 18 is removed permanently upon purchase of the vehicle, the seller and purchaser each receive one of the front and middle pages 22, 24, and the back page 26 is discarded along with the backing sheet 36.

Although the preferred embodiment of the method and apparatus of the invention has been illustrated and described herein, it is intended to be understood by those skilled in the art that various modifications and omissions in form and detail may be made without departing from the spirit and scope of the invention as defined by the following claims.

What is claimed is:

1. An assembly mountable on a transparent member, such as an automobile window, said assembly comprising the combination of:

a backing sheet having a mounting surface bounded by an outer periphery;

a layer of pressure sensitive adhesive carried by a marginal area of said surface; said layer having an outer boundary substantially coextensive with said periphery;

a sheet material cover having an attaching surface substantially coextensive with said marginal area, and inner edges that define a center opening in said cover adjacent to a center portion of said mounting surface; said attaching surface being releasably adhesively attached to said marginal area of said mounting surface by said layer; and a multipart form including a back page and a front page; said back page being substantially coextensive with and adhesively attached to said center portion; and said front page being attached to said back page along an edge portion thereof and having a front surface positioned to be visible through a transparent member on which the form has been mounted by removing said cover and pressing said layer against said member.

2. An assembly as described in claim 1, in which said center portion is made from a transparent material that protects said back page from damage, and said back page has a back surface positioned to be visible through said center portion.

3. An assembly as described in claim 1, in which said cover has a separate corner portion positioned and dimensioned to be grasped by the tip of a person's thumb to facilitate separation of said cover from said backing sheet.

4. An assembly as described in claim 2, in which said transparent material is continuous across the entire extent of said back page to protect said back page from moisture and other environmental factors.

5. A method of mounting a multipart form on a transparent member, such as an automobile window, said form being of the type having a back page and a front page attached to said back page along an edge portion thereof, said method comprising:

providing a backing sheet having a mounting surface with a marginal area that carries a layer of pressure sensitive adhesive;

providing a cover releasably adhesively attached to said marginal area by said layer, and providing said cover with a center opening adjacent to a center portion of said backing sheet;

adhesively attaching the back surface of said back page to said center portion;

peeling said cover off said backing sheet;

positioning said layer and the front surface of said front page adjacent to a surface of said transparent member;

pressing said layer against said surface of said member to releasably adhesively attach said backing sheet to said member around substantially the entire periphery of said backing sheet; and allowing said backing sheet to hold the form flush against said surface of said member.

6. A method as described in claim 5, in which said layer extends over and is carried by substantially the entire extent of said mounting surface; and in which the steps of providing said cover and providing said cover with said opening comprise providing a sheet of cover material adhered to substantially the entire extent of said mounting surface by said layer, cutting substantially through said sheet of cover material but not through said backing sheet along a path defining said center portion, and peeling the portion of said sheet of cover material adjacent to said center portion off said backing sheet.

7. A method as described in claim 6, which further comprises forming a separate corner portion of said cover by cutting substantially through said cover but not through said backing sheet, and dimensioning said corner portion to be grasped by the tip of a person's thumb; and in which the step of peeling said cover off comprises grasping said corner portion.

8. A method as described in claim 5, in which said center portion is made from a transparent material, and the step of attaching the back surface of said back page includes positioning said back surfaces to be visible through said center portion; and which comprises allowing said transparent material to protect said back page from damage.

9. A method as described in claim 8, comprising allowing said transparent material to protect said back page from moisture and other environmental factors.

10. A method as described in claim 5, which further comprises forming a separate corner portion of said cover by cutting substantially through said cover but not through said backing sheet, and dimensioning said corner portion to be grasped by the tip of a person's thumb; and in which the step of peeling said cover off comprises grasping said corner portion.

* * * * *

UNITED STATES PATENT AND TRADEMARK OFFICE

CERTIFICATE OF CORRECTION

PATENT NO. : 4,864,755

DATED : September 12, 1989

INVENTOR(S) : B. Victor Owens

It is certified that error appears in the above-identified patent and that said Letters Patent is hereby corrected as shown below:

In the Abstract, the 7th and 8th lines from the top, "corner (b 60)" should be -- corner (60) --.

In the Abstract, the 5th line from the bottom, "the automobile" should be -- an automobile --.

Col. 4, line 67, "drawing" should be -- drawings --.

Claim 8, column 10, line 23, "surfaces" should be -- surface --.

Signed and Sealed this

Twelfth Day of November, 1991

*Attest:*

*Attesting Officer*

HARRY F. MANBECK, JR.

*Commissioner of Patents and Trademarks*